US005671985A

United States Patent [19]

Grieser et al.

[11] Patent Number: 5,671,985

[45] Date of Patent: Sep. 30, 1997

[54] DRAWER INTERLOCK ASSEMBLY

[75] Inventors: Jerry D. Grieser, Archbold; Richard A. Nelson, Napoleon, both of Ohio; Michael J. McGinnis, Hudson, N.H.; Richard Steinberg, Bedford, N.H.; James J. Decknick, Manchester, N.H.

[73] Assignees: Sauder Woodworking Co., Archbold, Ohio; Keller Products, Inc., Manchester, N.H.

[21] Appl. No.: 703,506

[22] Filed: Aug. 27, 1996

[51] Int. Cl.[6] ..... E05B 65/46

[52] U.S. Cl. ..... 312/221; 312/217

[58] Field of Search ..... 312/217, 218, 312/219, 221

[56] References Cited

U.S. PATENT DOCUMENTS 3,589,783 6/1971 Studinski ..... 312/217

FOREIGN PATENT DOCUMENTS 1471653 4/1977 United Kingdom ..... 312/217

*Primary Examiner*—Peter M. Cuomo
*Assistant Examiner*—Gerald A. Anderson
*Attorney, Agent, or Firm*—Emch, Schaffer, Schaub & Porcello Co, L.P.A.

[57] ABSTRACT

A drawer interlock assembly for a furniture article having at least first and second drawers. A track member is positioned on the furniture article. The assembly includes at least first and second locking members slidingly mounted in the track member. The locking members are interconnected by at least one interconnection strip. Each of the locking members includes a locking projection. The assembly further includes at least first and second drawer members attached to the first and second drawers, respectively. Each of the drawer members includes a first ramp and a second ramp. Engagement of the locking projections with the first and second ramps allows only one drawer of the furniture article to be opened at a time.

17 Claims, 9 Drawing Sheets

DRAWER INTERLOCK ASSEMBLY

BACKGROUND OF THE INVENTION

The present invention relates to a device for locking drawers of a furniture article. More specifically, the invention is directed to a drawer interlock assembly that allows one drawer to be opened while locking the remaining drawers in closed positions.

It has been found that when two or more drawers in an upright cabinet are opened, the cabinet can fall forward onto a person opening the drawers. This has been a problem with juvenile furniture in which children have been seriously injured by falling cabinets and drawers.

Ready-to-assemble ("RTA") furniture consists of furniture components that are sold to consumers in an unassembled condition. After purchase, the consumer assembles the RTA furniture according to the instructions provided with the furniture. In order to be commercially successful, an RTA furniture article must be economical and easy to assemble. Due to its relatively light nature, an RTA furniture article would benefit from an inexpensive and simple drawer interlock assembly.

Examples of drawer locking systems are disclosed in U.S. Pat. Nos. 3,969,008; 4,425,013; 4,637,667; 4,925,257; 4,966,423; 5,184,887; and 5,411,327. It has been found that the types of locking systems disclosed in these references are unsuitable for RTA furniture because they are too expensive and complex.

There is a need for an economical and easy-to-assemble drawer interlock assembly for RTA furniture. The present invention satisfies this need.

SUMMARY OF THE INVENTION

The present invention is directed to a drawer interlock assembly for a furniture article having at least first and second drawers. A track member is attached to the furniture article.

The assembly further includes at least first and second locking members slidingly mounted in the track member. The locking members are interconnected by at least one interconnection strip. Each of the locking members includes a locking projection.

The assembly further includes at least first and second drawer members attached to the first and second drawers, respectively. Each of the drawer members includes a first ramp and a second ramp. The first ramp of the first drawer member has a guiding surface that engages the locking projection of the first locking member to cause the second locking member to move from a first position to a second position as the first drawer is opened. The second ramp of the second drawer member has a locking surface that engages the locking projection of the second locking member at the second position to prevent the second drawer from opening.

It is the primary object of the present invention to provide an economical and easy-to-assemble drawer interlock assembly for furniture.

Other objects and advantages of the present invention will become apparent to those skilled in the art upon a review of the following detailed description of the preferred embodiment and the accompanying drawings.

DETAILED DESCRIPTION OF THE PREFERRED EMBODIMENT

Figure 1:
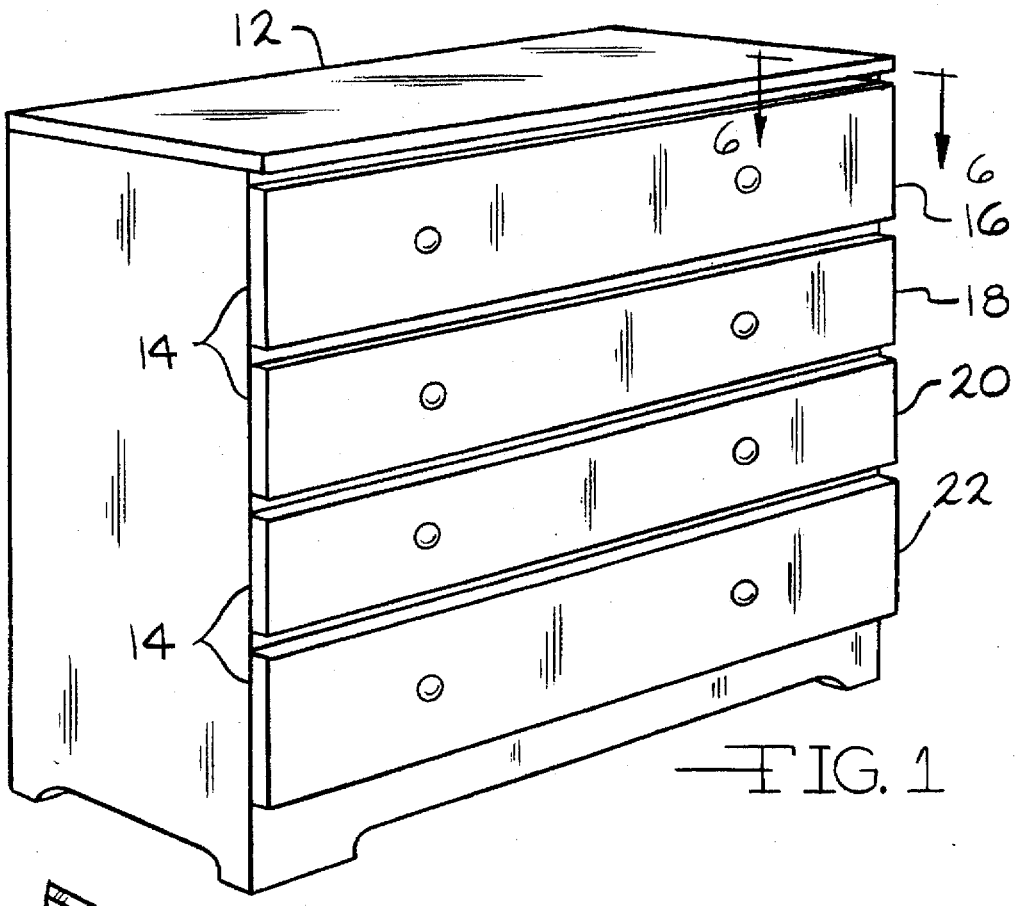
FIG. 1 is a perspective view of a furniture article that includes a drawer interlock assembly according to the present invention.
Figure 6:
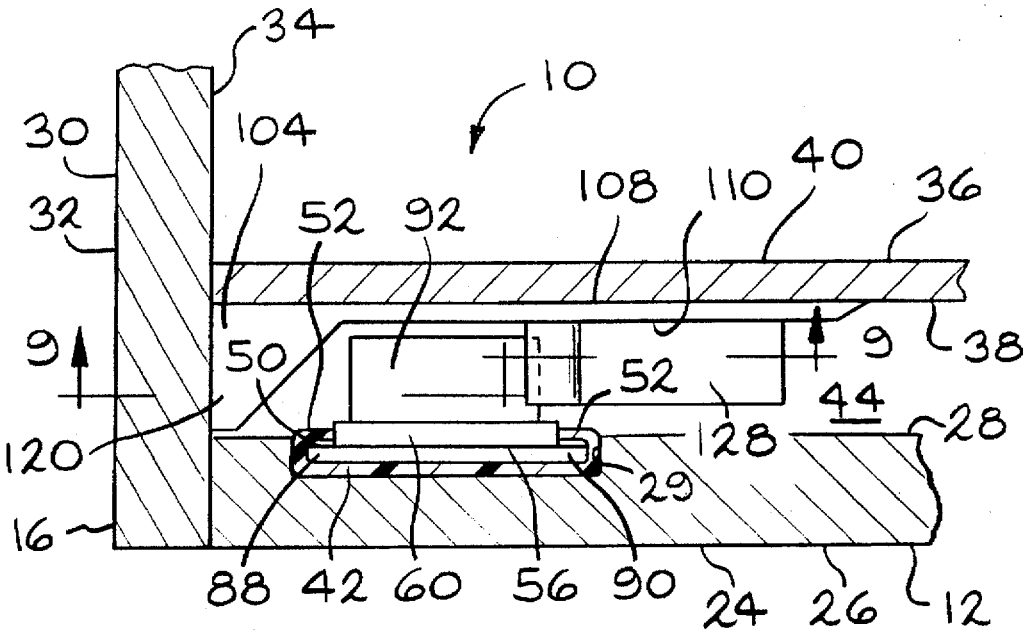
FIG. 6 is a cross-sectional view taken through line 6—6 of FIG. 1.
Figure 7:
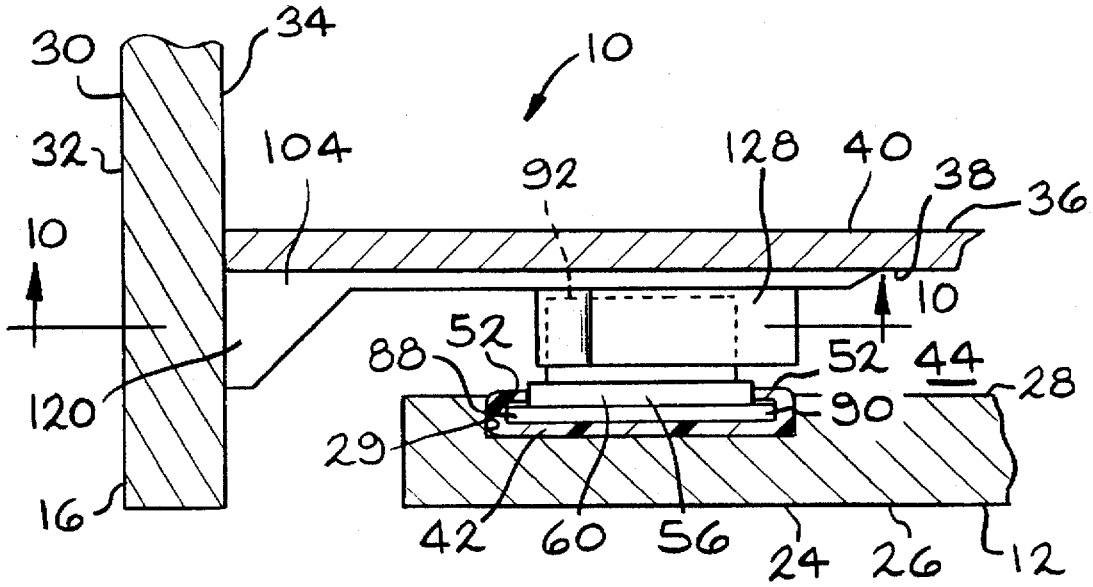
FIG. 7 is a cross-sectional view similar to the view of FIG. 6.
Figure 8:
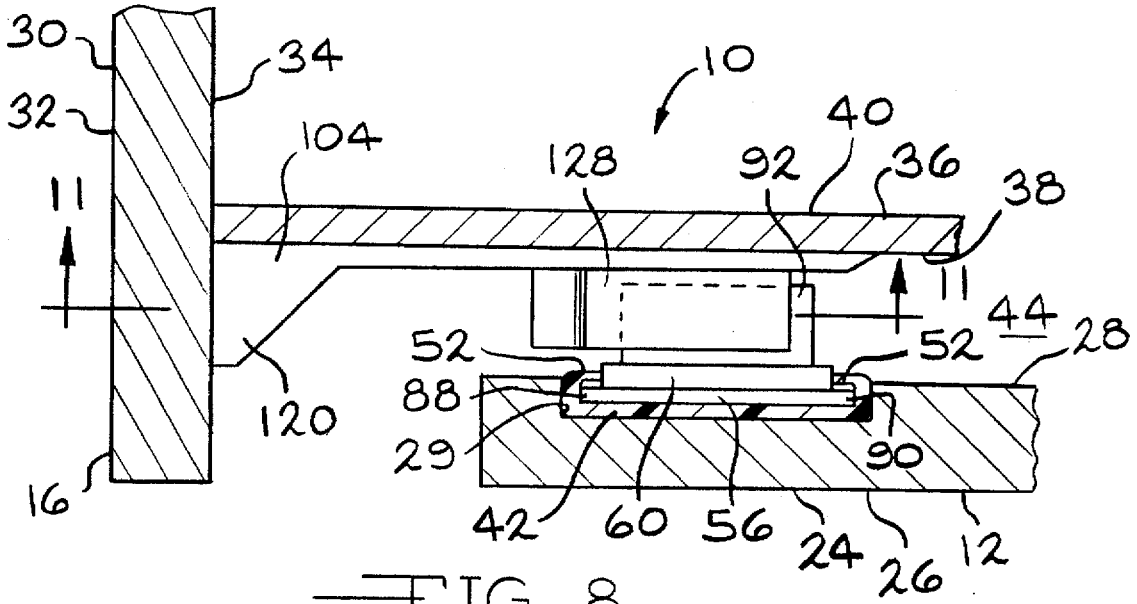
FIG. 8 is a cross-sectional view similar to the view of FIG. 6.

The preferred embodiment and best mode of the present invention will now be described in detail with reference being made to the drawings. The drawer interlock assembly of the present invention is indicated generally in the drawings by the reference number "10". Referring to FIG. 1, the assembly 10 can be used in conjunction with, for example, a furniture article 12 such as a dresser having a plurality of drawers 14 that are moveable between open and closed positions. The furniture article 12 shown in FIG. 1 includes a first drawer 16, a second drawer 18, a third drawer 20 and a fourth drawer 22. However, it should be understood that the assembly 10 can be used in conjunction with any furniture article having two or more drawers that are arranged vertically with respect to one another. As shown in FIG. 6, the furniture article 12 includes a sidewall 24 having an outside surface 26 and an inside surface 28. The inside surface 28 defines a groove 29. The first drawer 16, as well as the other drawers, includes a front panel 30 having an exterior surface 32 and an interior surface 34. The first drawer 16, as well as the other drawers, includes a drawer wall 36 having an outer surface 38 and an inner surface 40. The outer surface 38 of the drawer wall 36 is opposed to and spaced from the inside surface 28 of the sidewall 24 of the furniture article 12 to define a space 44. As shown in FIG. 6, the outer surface 38 and the inside surface 28 are substantially parallel.

Figure 2:
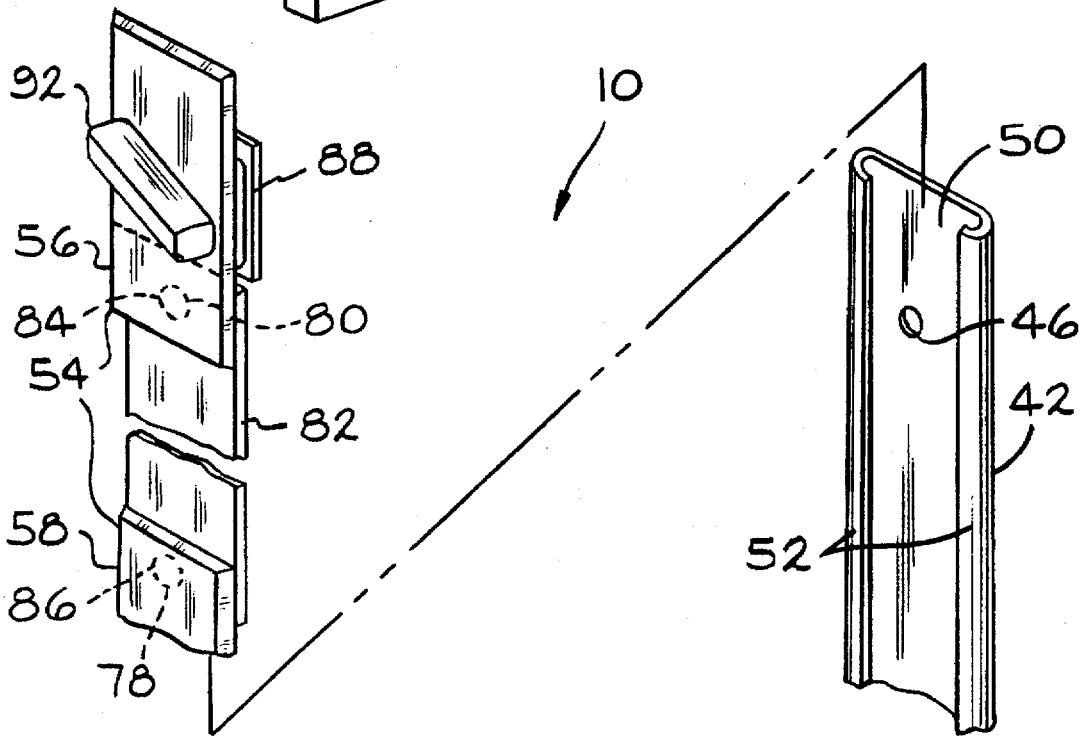
FIG. 2 is a perspective view showing the drawer interlock assembly according to the present invention.
Figure 9:
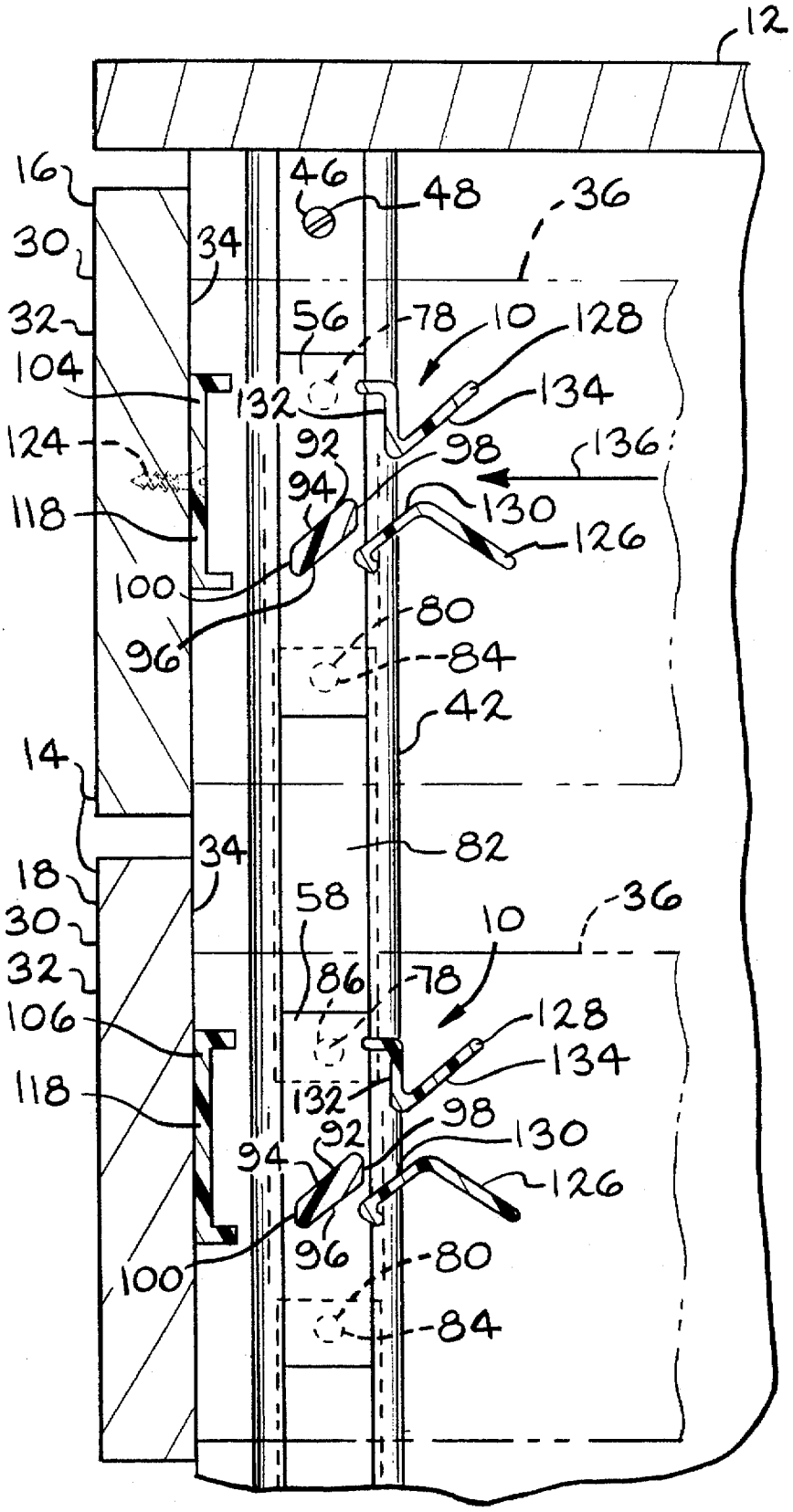
FIG. 9 is a cross-sectional view taken through line 9—9 of FIG. 6.

Referring to FIGS. 2, 6 and 9, the assembly 10 includes a track member 42 that is positioned in the groove 29 defined by the inside surface 28 of the sidewall 24 of the furniture article 12. When so positioned, the track member 42 is adjacent each of the drawers 14. Referring to FIGS. 2 and 9, the track member 42 defines at least one opening 46 through which a fastening device such as a screw 48 can be inserted to attach the track member to the inside surface 28 of the sidewall 24 in the groove 29. The track member 42 can also be press-fit in the groove 29 thereby eliminating the need for the openings 46 and the screws 48. Referring to FIGS. 2 and 6, the track member 42 defines a U-shaped channel 50 having a pair of opposed inwardly extending flanges 52.

Referring to FIGS. 2–4 and 9, the assembly 10 includes at least two locking members 54. The number of locking members 54 depends on the number of drawers 14 of the furniture article 12. In the present embodiment, there are four drawers 14 and thus four locking members 54. For the purposes of description, the present drawings show first and second locking members 56 and 58 that correspond to the first and second drawers 16 and 18, respectively.

Figure 3:
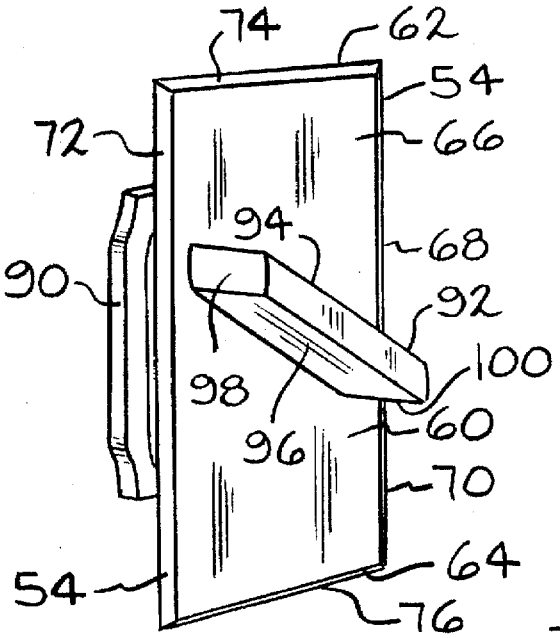
FIG. 3 is a perspective view of the front of a locking member according to the present invention.
Figure 4:
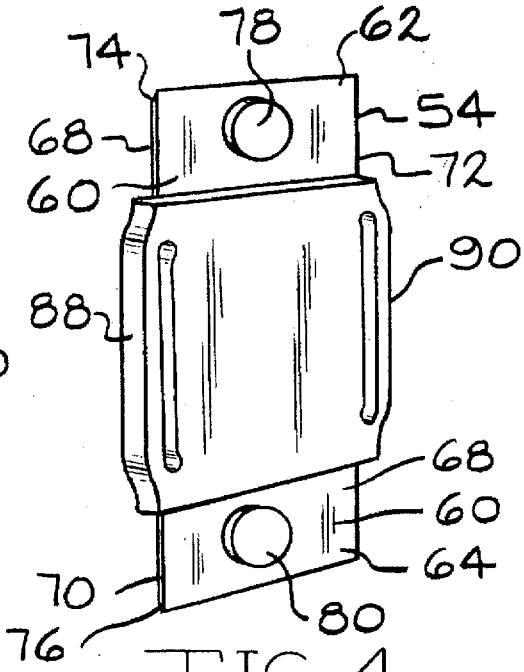
FIG. 4 is a perspective view of the back of the locking member shown in FIG. 3.

Referring to FIGS. 3 and 4, each of the locking members 54 includes a rectangular body 60, having a top 62, a bottom 64, a front surface 66, a back surface 68, a first side 70 and a second side 72. A top chamfer 74 angles downwardly from the back surface 68 to the front surface 66 adjacent the top 62. A bottom chamfer 76 angles upwardly from the back surface 68 to the front surface 66 adjacent the bottom 64. As shown in FIG. 4, each of the locking members 54 includes a first tab 78 adjacent the top 62 and a second tab 80 adjacent the bottom 64 on the back surface 68 of the body 60.

As shown in FIGS. 2 and 9, the assembly 10 includes a flexible interconnection strip 82 that defines a first tab opening 84 and a second tab opening 86. As shown in FIG. 9, the first tab opening 84 is adapted to receive the second tab 80 of the first locking member 56. The second tab opening 86 is adapted to receive the first tab 78 of the second locking member 58. The attachment of the interconnection strip 82 to the first and second locking members 56 and 58 allows for interconnection of such members. The number of interconnection strips 82 used in the assembly 10 depends on the number of locking members 54. The length of an individual interconnection strip 82 is determined by the spacing of the drawers 14 of the furniture article 12.

Referring again to FIG. 4, each of the locking members 54 includes a flexible first guide member 88 and a flexible second member 90 positioned on the back surface 68. The first and second guide members 88 and 90 extend from the back surface 68 to predetermined points beyond the first and second sides 70 and 72, respectively, of the body 60.

Referring to FIGS. 2, 6 and 9, the interconnected first and second locking members 56 and 58, as well as the other locking members 54, are slidably mounted in the track member 42. The interconnection strips 82 are also positioned in the track member 42. As shown in FIG. 6, the locking members 54 as represented by the first locking member 56 are adapted to be received by the U-shaped channel 50 of the track member 42. The first and second guide members 88 and 90 flexibly engage the U-shaped channel 50 to guide the first locking member 56 along the track member 42. The first and second guide members 88 and 90 also maintain the first locking member 56 in the track member 42. Due to their flexible nature, the first and second guide members 88 and 90 can be compressed and decompressed so that they are always in frictional contact or engagement with the track member 42. This contact maintains the locking members 54 in proper positions in the track member 42 without slippage, while allowing the locking members to slide in the track member. The pair of flanges 52 of the track member 42 engage the first and second guide members 88 and 90 to prevent the first locking member 56 from being pulled outwardly from the track member 42. The track member 42 properly aligns the locking members 54 during use of the assembly 10.

Referring to FIGS. 2, 3 and 9, each of the locking members 54 includes a locking projection 92. As shown in FIG. 3, the locking projection 92 is positioned on the front surface 66 of the body 60. As shown in FIGS. 3 and 9, each of the locking projections 92 includes an upper surface 94, a lower surface 96, a front edge 98 and a back edge 100.

Figure 5:
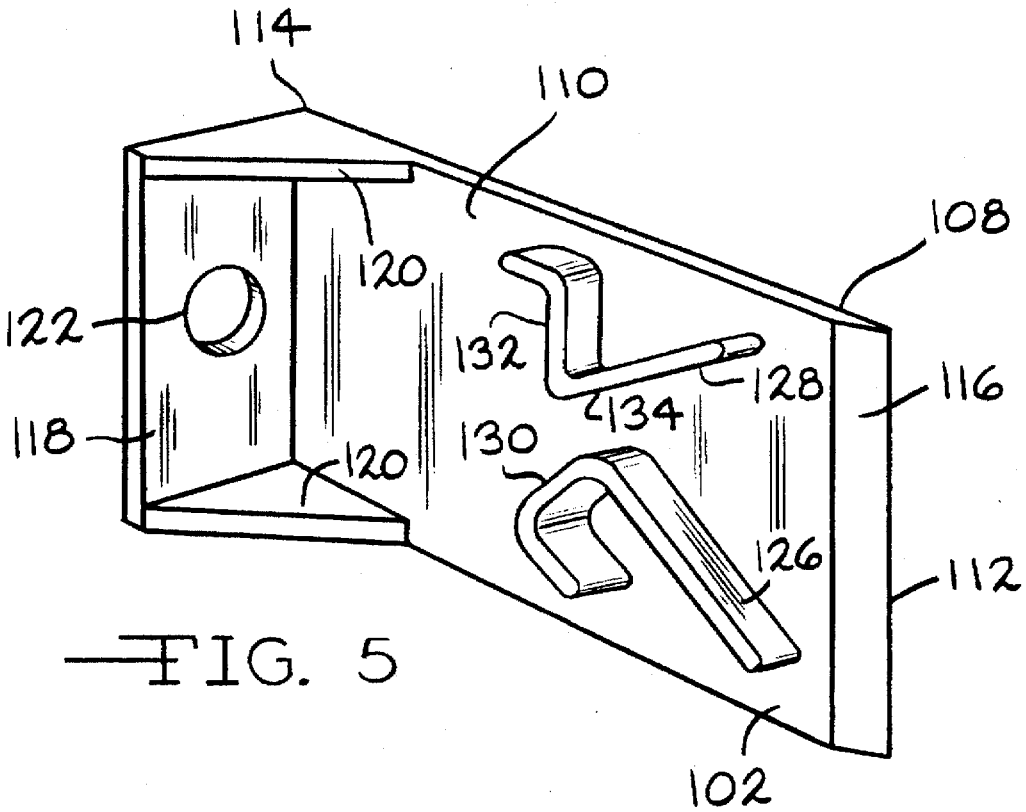
FIG. 5 is a perspective view of a drawer member according to the present invention.

Referring to FIGS. 5 and 9, the assembly 10 includes drawer members 102. The number of drawer members 102 depends on the number of drawers 14 of the furniture article 12. For the purposes of description, the drawings show a first drawer member 104 and a second drawer member 106. As shown in FIG. 5, each of the drawer members 102 includes a drawer side 108, a track side 110, a first end 112 and a second end 114. The first end 112 includes a chamfer 116 that angles inwardly from the drawer side 108 to the track side 110. The second end 114 includes a bracket 118 that extends substantially perpendicular from the track side 110. The bracket 118 is supported by a pair of support members 120. The bracket 118 defines at least one opening 122 for receiving a fastening member such as a screw 124 (FIG. 9) that attaches the drawer member 102 to the interior surface 34 of the front panel 30 of a drawer 14.

Still referring to FIGS. 5 and 9, each of the drawer members 102 includes a first ramp 126 and a second ramp 128 that are positioned on the track side 110. The first ramp 126 has a guiding surface 130. The second ramp 128 includes a locking surface 132 and a follower surface 134.

The track member 42, the locking members 54, the interconnection strips 82 and the drawer members 102 can be made from a variety of materials, with plastic being preferred for cost, weight and durability considerations.

Figure 10:
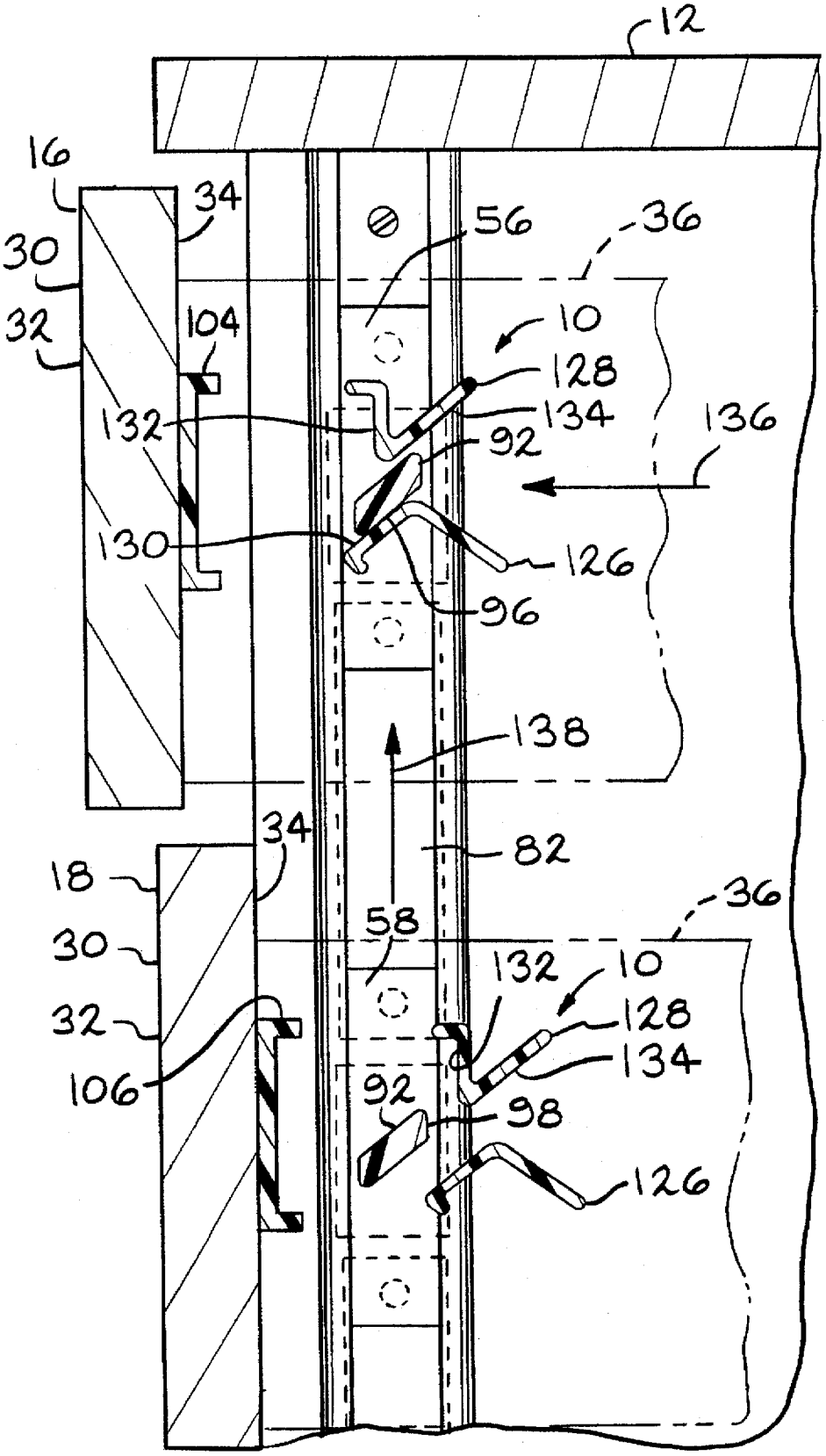
FIG. 10 is a cross-sectional view taken through fine 10—10 of FIG. 7.

The operation of the assembly 10 will now be described. Referring to FIG. 9, the first and second drawers 16 and 18 are shown in closed positions. As shown in FIGS. 9 and 10, when the first drawer 16 is moved away from the furniture article 12 in the direction indicated by the arrow 136, the lower surface 96 of the locking projection 92 of the first locking member 56 engages the guiding surface 130 of the first ramp 126. This causes the first locking member 56, the interconnection strip 82 and the second locking member 58 to move upwardly in the direction indicated by the arrow 138.

Figure 11:
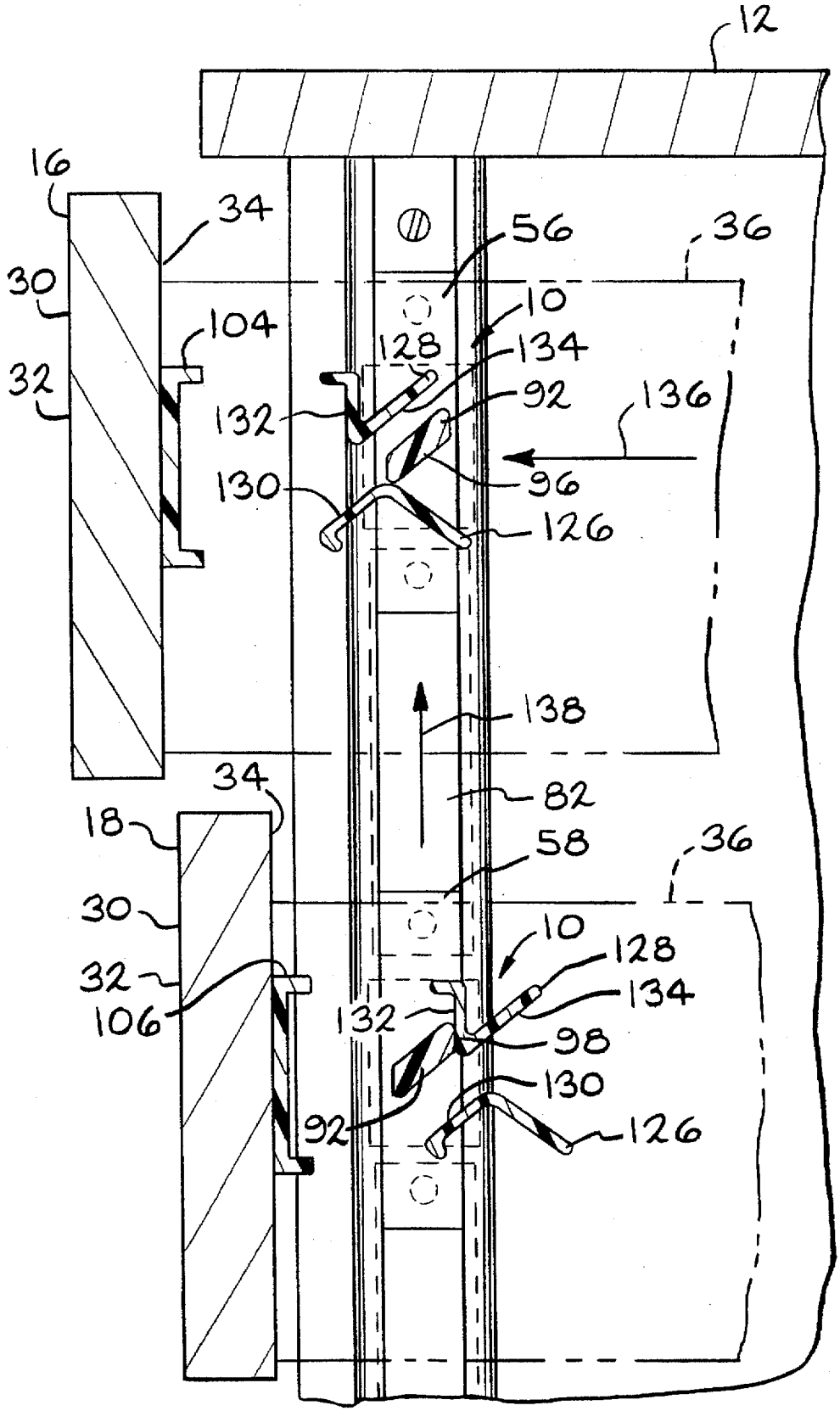
FIG. 11 is a cross-sectional view taken through line 11—11 of FIG. 8.

Referring to FIG. 11, as the first drawer 16 is moved farther away from the furniture article 12 in the direction indicated by the arrow 136, the locking projection 92 of the first locking member 56 continues to move along the guiding surface 130 until it clears the first ramp 126. This causes further upward movement of the first locking member 56, the interconnection strip 82 and the second locking member 58 in the direction indicated by the arrow 138. At the point where the locking member 92 of the first locking member 56 clears the first ramp 126 of the first drawer member 104, the front edge 98 of the locking projection 92 of the second locking member 58 engages the locking surface 132 of the second ramp 128 of the second drawer member 106. As it will be appreciated, the engagement of the locking projection 92 of the second locking member 58 with the second ramp 128 of the second drawer member 106 locks the second drawer 18 in a closed position to prevent the second drawer from opening.

Figure 12:
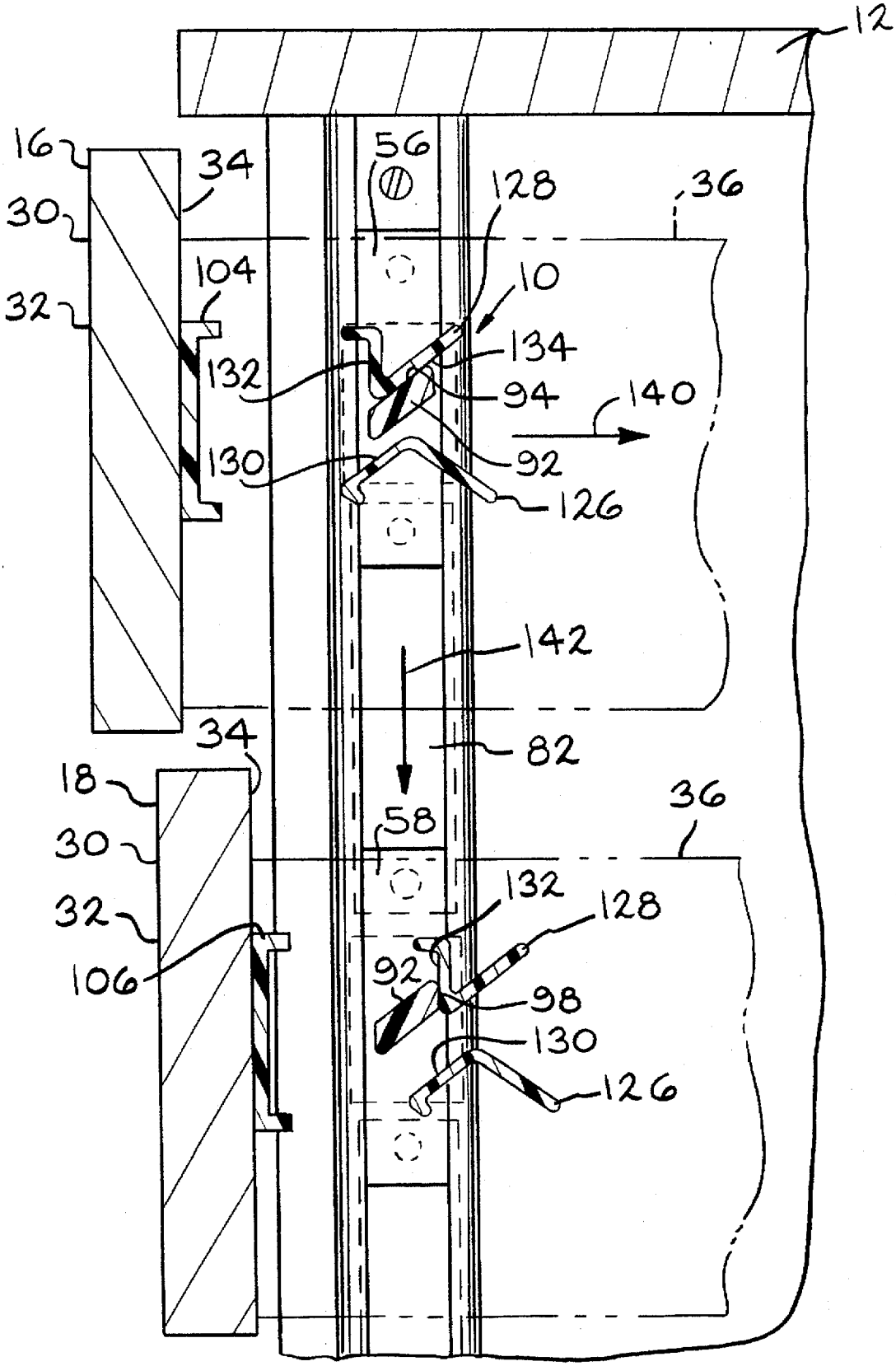
FIG. 12 is a cross-sectional view similar to the view of FIG. 10.

Referring to FIG. 12, when the first drawer 16 is moved toward the furniture article 12 in the direction indicated by the arrow 140, the upper surface 94 of the locking projection 92 of the first locking member 56 engages the follower surface 134 of the second ramp 128 of the first drawer member 104. This causes the first locking member 56, the interconnection strip 82 and the second locking member 58 to move downwardly in the direction indicated by the arrow 142. At the point shown in FIG. 12, the front edge 98 of the locking projection 92 of the second locking member 58 is engaged to the locking surface 132 of the second ramp 128 of the second drawer member 106.

Figure 13:
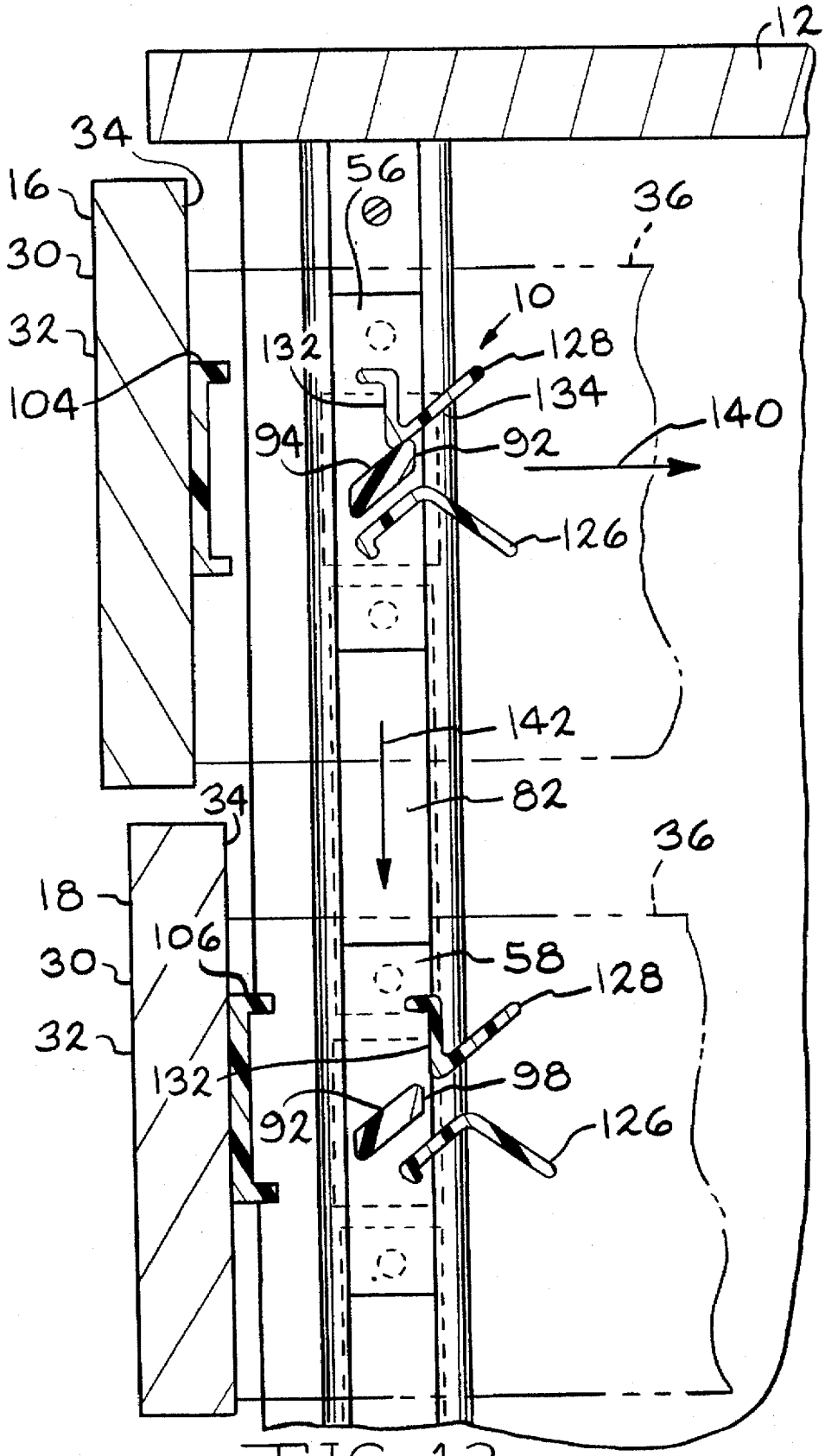
FIG. 13 is a cross-sectional view similar to the view of FIG. 10.

Referring to FIG. 13, as the first drawer 16 is moved farther in the direction of the arrow 140, the locking projection 92 of the first locking member 56 continues to move along the follower surface 134 of the second ramp 128 of the first drawer member 104. This causes the first locking member 56, the interconnection strip 82 and the second locking member 58 to move farther in the direction indicated by the arrow 142. This movement causes the front edge 98 of the locking projection 92 of the second locking member 58 to become disengaged from the locking surface 132 of the second ramp 128 of the second drawer member 106. At this point, either the first drawer 16 or the second drawer 18 is capable of being opened.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

We claim:

1. A drawer interlock assembly for a furniture article having at least first and second drawers, comprising:

a track member positioned on said furniture article;

at least first and second locking members slidingly mounted in said track member, each of said locking members including a body having a top, a bottom, a front surface, a back surface, a first side and a second side, said body including at least one tab positioned on said back surface, said locking members being interconnected by at least one interconnection strip defining at least one opening for receiving said tab, each of said locking members including a locking projection; and at least first and second drawer members attached to said first and second drawers, respectively, each of said drawer members including a first ramp and a second ramp, said first ramp of said first drawer member having a guiding surface that engages said locking projection of said first locking member to cause said second locking member to move from a first position to a second position as said first drawer is opened, said second ramp of said second drawer member having a locking surface that engages said locking projection of said second locking member at said second position to prevent said second drawer from opening.

2. The invention of claim 1, wherein said track member defines a substantially U-shaped channel having a pair of opposed inwardly extending flanges.

3. The invention of claim 2, wherein said track member is comprised of plastic.

4. The invention of claim 1, wherein said drawer members are comprised of plastic.

5. The invention of claim 1, wherein said body is substantially rectangular.

6. The invention of claim 1, wherein each of said drawer members includes a bracket defining an opening for receiving fastening means to attach said drawer member to said drawer.

7. The invention of claim 1, wherein said interconnection strip is positioned in said track member.

8. The invention of claim 1, wherein said interconnection strip is comprised of plastic.

9. The invention of claim 1, wherein said body includes guide means for guiding said body on said track member.

10. The invention of claim 9, wherein said guide means consists of at least two flexible guide members positioned on said back surface, said guide members extending beyond said first and second sides, said guide members engaging said track member to guide and maintain said locking member in said track member.

11. The invention of claim 1, wherein said locking projection is positioned on said front surface.

12. The invention of claim 11, wherein said locking projection includes an upper surface, a lower surface, a front edge and a back edge.

13. The invention of claim 1, wherein said locking members are comprised of plastic.

14. The invention of claim 1, wherein each of said drawer members includes a drawer side and a track side.

15. The invention of claim 14, wherein said first and second ramps are positioned on said track side.

16. The invention of claim 12, wherein said guiding surface of said first ramp of said first drawer member engages said lower surface of said locking projection of said first locking member.

17. The invention of claim 12, wherein said locking surface of said second ramp of said second drawer member engages said front edge of said locking projection of said second locking member.

* * * * *